United States Patent [19]

Giambalvo

[11] 4,249,773

[45] Feb. 10, 1981

[54] FOLDING PICNIC TABLE

[76] Inventor: Joseph Giambalvo, 1118 Willoughby Ave., Brooklyn, N.Y. 11237

[21] Appl. No.: 83,953

[22] Filed: Oct. 10, 1979

[51] Int. Cl.[3] ..... A47B 3/14

[52] U.S. Cl. ..... 297/159; 108/113

[58] Field of Search ..... 297/159, 124, 125; 108/113

[56] References Cited

U.S. PATENT DOCUMENTS

| | | | |
|---|---|---|---|
| 346,027 | 7/1886 | Decker | 108/113 |
| 1,862,911 | 6/1932 | Snyder | 108/113 |
| 2,257,550 | 9/1941 | Gay | 297/159 |
| 2,750,506 | 2/1957 | Howe | 297/159 |
| 2,983,308 | 5/1961 | Horowitz | 297/159 |
| 3,141,424 | 7/1964 | Seymour | 297/159 X |
| 3,256,037 | 6/1966 | Giambalvo | 297/159 |
| 3,259,426 | 7/1966 | Shaw et al. | 297/159 |
| 3,788,696 | 1/1974 | Loewen | 297/159 |

*Primary Examiner*—Francis K. Zugel

*Attorney, Agent, or Firm*—Browdy and Neimark

[57] ABSTRACT

A collapsible table and seat assembly, preferably a picnic table, can be conveniently folded into relatively small and compact form for storage or transportation. The table includes folding braces which connect the table legs and support the braces holding the table top. The braces open from a jack-knife position to a stop position slightly beyond rectilinear. Self-locating hook and guide elements ensure proper alignment of the two halves of the table tops when placing the table into the opened position. The table is preferably made with top and seats of wood, and remaining portions of light-weight metal.

10 Claims, 16 Drawing Figures

FIG.1
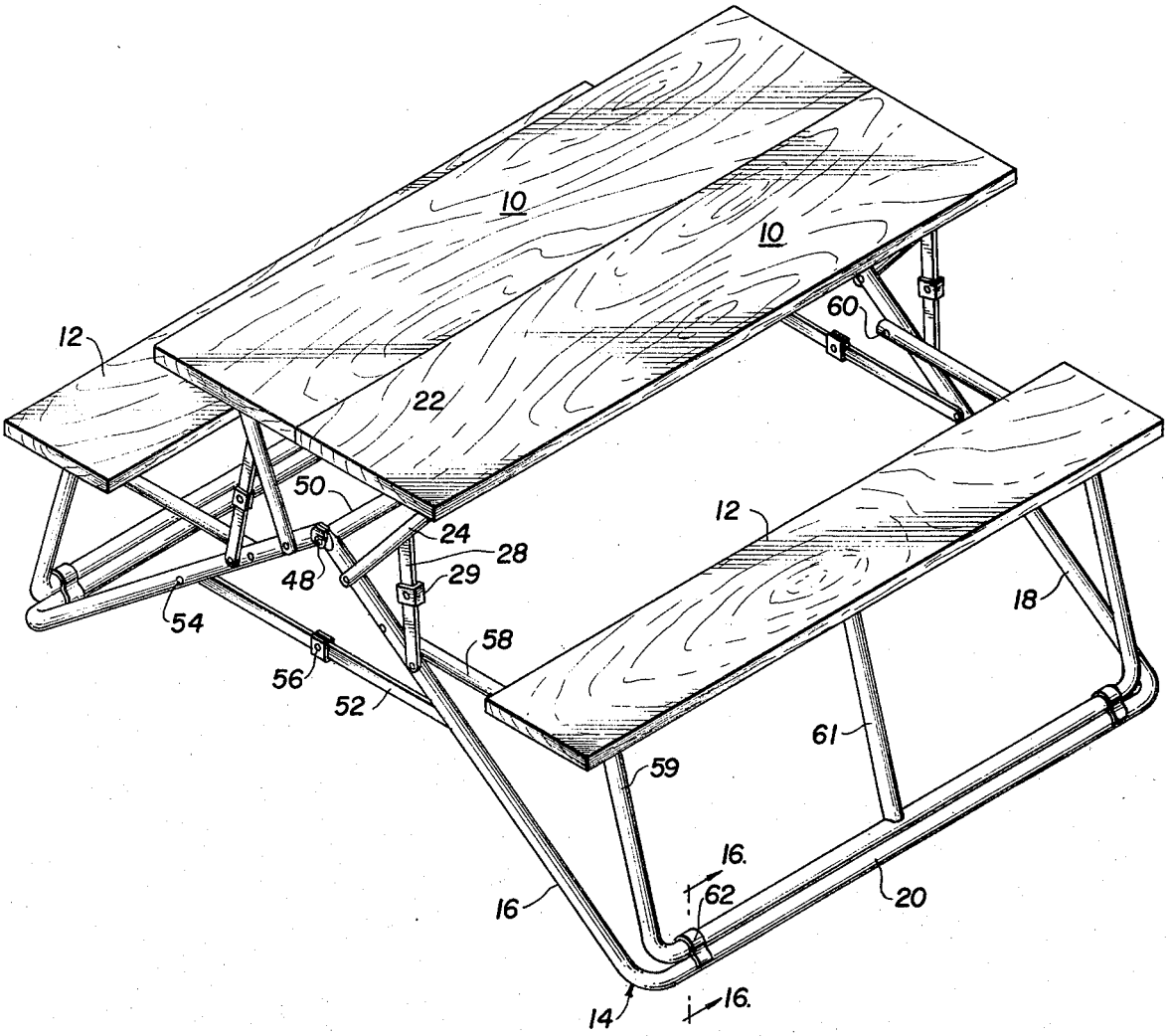
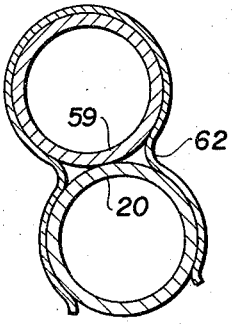
FIG.16

FIG. 2
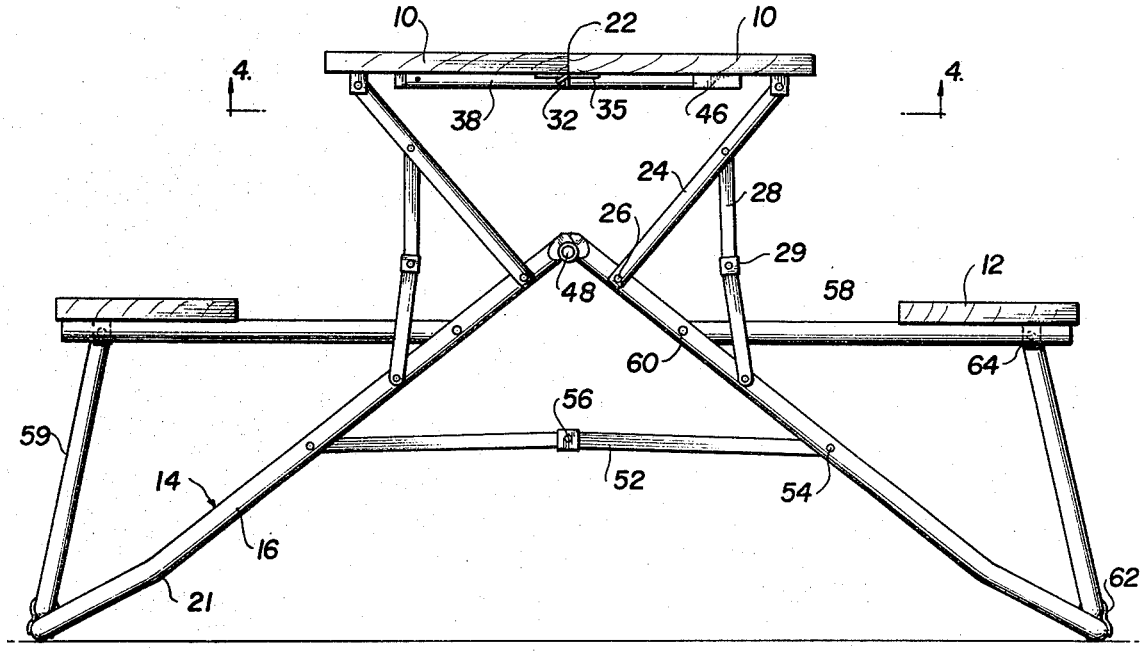
FIG. 3
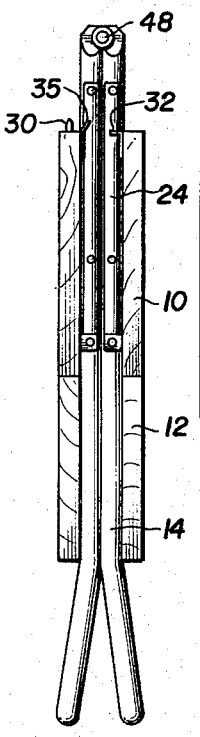
FIG. 4
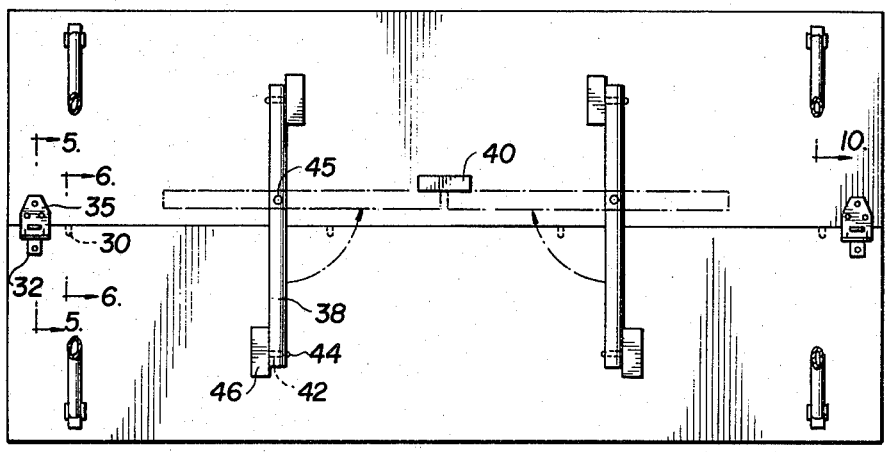
FIG. 5
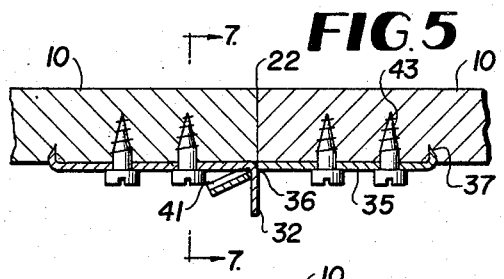
FIG. 6
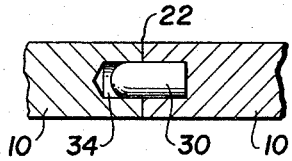
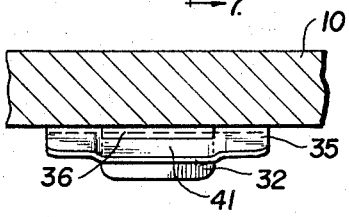
FIG. 7

FIG.8
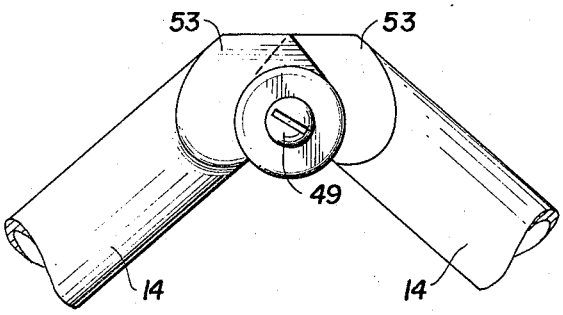
FIG.9
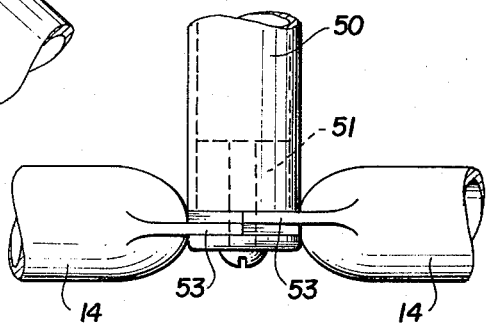
FIG.10
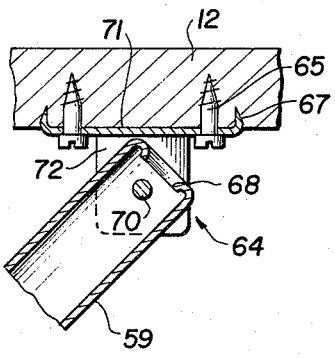
FIG.11
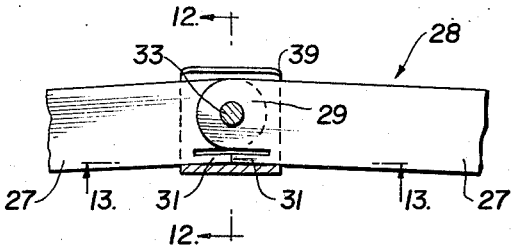
FIG.12
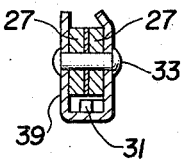
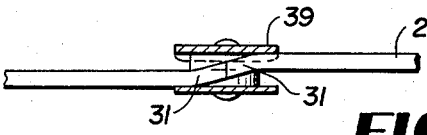
FIG.13
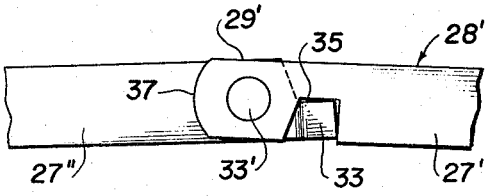
FIG.14
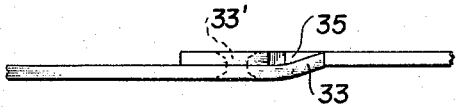
FIG.15

FOLDING PICNIC TABLE

BACKGROUND OF THE INVENTION

The present invention relates to improved features for collapsible table and seat assemblies and more particularly to improvements to a unitary structure which can conveniently be folded into relatively small and very compact form for storage or transportation and which may be readily unfolded into very stable operational position without need of tools, tightening, or adjustments of any kind.

More specifically, the present invention relates to improvements to my previous U.S. Pat. No. 3,256,037 which comprises an all redwood foldable picnic table. The table of the present invention is made from both aluminum and redwood components in order to reduce its size and weight when folded for storage and transportation.

In the table's position, the improved brace structure form closed triangles. The strength and rigidity obtained from this triangular tension is significant compared to prior art devices.

In the table's closed position parallelism is maintained but the width and weight is greatly reduced.

Other improvements in the table of the present invention relate to the specific folding braces which close the triangles of the structure supporting the table surface, self-locating and locking means for connecting table leaves, and self-locking clips which secure the seat braces to the table legs.

Although the table of U.S. Pat. No. 3,256,037 has operated well in practice, the improvements described herein will make folding of the table of the present invention more convenient for transporting while increasing its stability while in operation.

SUMMARY OF THE INVENTION

It is therefore a primary object of the present invention to provide a collapsible table and seat assembly which can be conveniently folded into relatively small and compact form for storage or transportation without tools, tightening or adjustment of any kind.

Another object of the present invention is to provide a unitary device which affords free movement of associated elements from a folded to an unfolded operative position and which maintains such elements in erected stable position and permits ready movement of the elements into the folded position.

A further object of the instant invention resides in the provision of a foldable picnic table which includes novel support and brace elements and which, therefore, is exceptionally strong and lightweight in view thereof and still compactly foldable for storage and carrying purposes.

Another object of the present invention is to provide a device of the foregoing character which may be fabricated of wood, metal, or other suitable material.

Another general object of the present invention is to provide a foldable picnic table which will be simple in structure, economical of manufacture, easily and quickly erected and highly effective in use.

Other objects and advantages of the instant foldable picnic table will be set forth in part hereinafter and in part will be obvious herefrom, or may be learned by practice of the invention, the same being realized and attained by means of the structure defined and pointed out in the appended claims.

BRIEF DESCRIPTION OF THE DRAWINGS

FIG. 1 is a perspective view of the instant picnic table in the unfolded operative position;

FIG. 2 is an end elevational view of the unfolded table of the present invention;

FIG. 3 is an end elevational view of the table of the present invention in the folded inoperative position;

FIG. 4 is a fragmentary bottom view of the table from the plane of section 4—4 of FIG. 2;

FIG. 5 is a fragmentary side cross-sectional view on an enlarged scale taken along line 5—5 of FIG. 4 of the improved end hooks and slot member of the present invention;

FIG. 6 is a fragmentary side cross-sectional view on an enlarged scale taken along line 6—6 of FIG. 4 of the table top dowel and dowel holes;

FIG. 7 is a fragmentary side cross-sectional view on an enlarged scale taken along line 7—7 of FIG. 5 of the end hooks and slot member;

FIG. 8 is a fragmentary side elevational view on an enlarged scale of the pivot hinge of the U-shaped legs of the instant picnic table;

FIG. 9 is a fragmentary top view on an enlarged scale of the pivot hinge between the legs and the center beam member of the instant picnic table;

FIG. 10 is a fragmentary side cross-sectional view on an enlarged scale taken along line 10—10 of FIG. 4 of the fastening plate used to secure the table supports and the bent legs to the table top and the seats of the picnic table of the present invention.

FIG. 11 is a fragmentary side view of the folding brace on an enlarged scale used as supporting members in the instant picnic table;

FIG. 12 is a side elevational view taken along line 12—12 of FIG. 11 of the folding brace;

FIG. 13 is a top view taken along line 13—13 of FIG. 11 of the folding brace;

FIG. 14 is a fragmentary side elevational view of an alternative embodiment of the folding brace on an enlarged scale used as supporting members on the instant picnic table;

FIG. 15 is a fragmentary bottom view of the alternative folding brace shown in FIG. 14; and FIG. 16 is a cross-sectional view taken along line 16—16 of FIG. 1 of the leg bracket used on the instant picnic table.

DETAILED DESCRIPTION OF PREFERRED EMBODIMENTS

Referring now in detail to the preferred embodiments of the invention illustrated in the accompanying drawings, FIG. 1 shows the foldable picnic table designated generally by numeral 1 and shown therein in the unfolded operative position.

Table 1 includes top surface leaf portions 10; seat portions 12; and U-shaped legs 14 comprising identical side portions 16 and 18 and lower member 20 which is in contact with the table's supporting surface when in unfolded and operative position. Side portions 16 and 18 are slightly bent as shown at 21 in FIG. 2 in order to add further stability to the table when in operative position.

Top leaves 10 are preferably two distinct portions of substantially the same size being separated at parting line 22. The table top is maintained in operative position in FIGS. 1 and 2 by a support assembly shown collectively in FIGS. 2 and 4. Each table leaf 10 is pivotally hinged at its end to table supports 24 by the pivot means shown in FIG. 10. Table supports 24 are in turn pivotally hinged to legs 14 at points 26. The stability of the operative table top is assured by four folding braces 28 pivotally connected in a conventional manner between table supports 24 and legs 14. The center pivot 29 of braces 28, which may be either the embodiment shown in FIGS. 11–13 or that shown in FIGS. 14–15, when in the open position is rotated slightly past center where each embodiment locks.

The embodiment of FIGS. 11–13 is the preferred embodiment of the center pivot 29 of braces 28. Each arm 27 of the brace 28 is identical and has formed therein a tab 31 which is bent in slightly toward the center as can clearly be seen in FIG. 13. When two arms 27 are juxtaposed and pivot pin 33 inserted, it can be seen that the arms may be rotated about the pivot pin until the two tabs 31 come into contact with one another. Preferably, the tabs are shortened slightly so that they do not come into contact until the arms have already pivoted slightly past the rectilinear line, as can be seen in FIG. 2. In this manner, greater weight can be placed on the brace without fear of the brace inadvertently becoming unlocked. U-shaped cover 39 covers the center pivot 29 and provides an added degree of safety and protection from dirt or other material which may affect efficient operation. It can clearly be seen that this cover prevents the tab 31 from pinching the fingers of the user when the table is being opened. This particular design is greatly preferred because of the safety feature caused by the line of contact between the two tabs 31 being directly over the pivot pin 33, and thus permitting the use of a cover 39. It is further preferred because of the fact that each arm 27 may be manufactured identically.

An alternative embodiment for brace 28 is shown in FIGS. 14 and 15. In this embodiment arm 27′ is formed with a cut-out 35, and arm 27″ is formed with tab 33, which is bent slightly inward toward the longitudinal axis of the brace, as can be clearly seen in FIG. 15. The width of the tab 33 and the depth of the cutout 35 are chosen so that contact is made after the arms are rotated slightly past rectilinear. This feature is similar to that of the embodiment of FIGS. 11 to 13. End 37 of arm 27′ is rounded, to assure safety in handling the table during folding or unfolding.

The table supports 24 and folding braces 28 permit each table leaf 10 to be pivotally rotated from their inoperative position against legs 14 (FIG. 3) into the operative position. The table leaves 10 are maintained in their operative position by means of a plurality of devices which cause the leaves 10 to be self-locating and self-locking and to be held stably in position when in the operative position. Opposite leaves 10 are provided respectively with dowels 30 and dowel holes 34, as can be seen in detail in FIG. 6. In addition to the use of dowels and dowel holes, the leaves 10 are provided with a self-locating and self-locking end hook device. As can be seen in FIGS. 4, 5 and 7, opposite table leaves are provided respectively with end hooks 32 and slot members 35. The end hook and slot member hardware are firmly attached to the table leaves 10 by means of wood screws 43. Furthermore, the ends 37 of each member are bent 90° and sharpened so that they may be hammered into the table and thus help to provide secure attachment.

Slot member 35 has a slot 36 therein, through which the hook portion of the end hook 32 is inserted when the table leaves 10 are being located into place. Slot member 35 has a slightly depressed portion 31 in the center thereof leading to slot 36 and having a width identical to that of slot 36. End hook 32 may contact this depressed portion 41 and slide therealong into the slot 36 when the table leaves 10 are pivoting into the operative position, thereby causing the hardware to be self-locating and self-locking. This end hook mechanism, together with the dowels greatly simplify the matching and locking of the table leaves.

Added stability is provided by means of tie bars 38. The tie bars 38 are pivotably connected to one of the table leaves 10 at pivot point 45. A stop 40 is provided on the same table leaf to maintain the tie bars 38 in their inoperative position. After the table leaves 10 have been mated and locked into position, tie bars 38 are rotated 90° from their inoperative position into contact with cleats 46. Cleats 46 are provided with pins 44 which frictionally engage mating holes 42 in the tie bars 48. The tie bars 38 add strength to the tabletop and hold the table leaves 10 flat and in close contact.

U-shaped legs 14 are pivotally connected to one another at 48 and to center beam 50 by screw 49 as shown in greater detail in FIGS. 8 and 9. Screw 49 holds legs 14 and center beam 50 in pivotal engagement by its connection to plug 51 through the flattened end 53 of rounded legs 14. Plug 51 is tightly secured in each end of center beam 50 through friction or other appropriate means. The legs 14 are preferably made of 1″ diameter tubular aluminum in the embodiment shown in FIGS. 8 and 9. The pivot hinge is part of the tube. This simplifies construction.

In unfolded and operative position, legs 14 are held in open position at each end of the table by folding braces 52 which are pivotally connected to the legs 14 at points 54 as shown in FIG. 2. Braces 52 are pivotally foldable around points 54 and center pivot 56 to enable bringing legs 14 into a generally parallel folded position. The center pivot 56 of brace 52 is identical to that described above for brace 28 and may be as shown in FIGS. 11–13 or FIGS. 14–15, the preferred embodiment being that of FIGS. 11–13 for reasons discussed hereinabove.

In the table's open position braces 52 and 28 form closed triangles with their associated legs or supports. The strength and rigidity obtained from this triangular tension is significant compared to known picnic tables designed to be portable. The rigidity of the present invention is directly attributable at least in part to the specific design and placement of braces 52 and 28.

Seat support members 58 are mounted on each end of seat portions 12. The opposite end of each seat support member 58 is pivotally attached to legs 14 at 60 in a conventional manner.

U-shaped seat legs 59 are pivotally attached to portions 12 by pivot means 64. Pivot means 64 is shown in greater detail in FIG. 10. Like many of the other elements of the present table, seat legs 59 are formed of aluminum tube. A pivot bracket 71 is firmly attached to the bottom of seat portion 12. The ends of the bracket portion 67 are bent 90° and sharpened so that they may be pressed into the redwood and secured with wood screws 65, thus locking them permanently into place. Bracketing elements 72 extend on either side of the seat leg 59, and the seat leg 59 is held pivotally between the bracket portions 72 by means of a pivot pin 70. The open end of the tubing of the seat leg 59 has a rolled edge as shown at 68. All tubing used in the present table has such rolled edges for safety purposes.

Seat legs 59 are connectable to the lower member 20 of legs 14 when the table is in operative position by means of two self-locking clips 62 mounted on each seat leg 59, as can be seen in greater detail in FIG. 16. When bringing the seat portions 12 into operative position, the seat legs 59 may be quickly and securely locked to the table legs 14 by means of this self-locking clip 62. This clip is also easily releasable to assist in the folding of the table.

U-shaped seat legs 59 also preferably have a support bar 61 midway between the end members and pivoted to the bottom of seat portion 12 in a manner similar to that shown in FIG. 10. Support bar 61 adds stability and rigidity to table 1 when in the operative position.

The table legs 14 should be dimensioned, and the location of pivot means 64 should be chosen, such that seat leg 59 connects to lower member 20 of table leg 14 outside of the vertical projection of the end of seat 12. This causes the center of gravity of the table when in use to be within the leg, and causes the table to be substantially tilt-proof to prevent overturning.

To open the picnic table of the invention from the completely folded position shown in FIG. 3 to the operative position of FIGS. 1 and 2, legs 14 are spread out until movement is constrained by braces 52. Braces 52 are then locked by moving each upward into locked position. Table leaves 10 are then raised and braces 28 locked into the vertical position. Dowels 30 and end hooks 32 are matched with dowel holes 34 and slots 36 on opposite table leaves 10 at which point the leaves 10 are pressed down gently. The bars 38 are then rotated 90° into locked position with pins 44 engaging holes 42. The table is brought into final operative position by raising seats 12 and pressing connections 62 into lower leg members 20.

To close the table, seats 12 are raised so that clips 62 become unclipped, and seat legs 59 are swung up parallel to seat supports 58, and the seat allowed to swing down and rest upon table legs 14. Tie bars 38 are then rotated 90° until they contact stop 40. Table leaves 10 are lifted from the center to disengage dowels 30 and end hooks 32, and the table leaves 10 are swung one at a time downwardly to rest on the table supports 24. Vertical braces 28 are then pressed outward to allow the table leaves 10 and table supports 24 to swing in to rest on the table legs 14. Finally, the horizontal leg braces 52 are pressed downwardly, and the legs folded together.

It will be understood that the instant structure may be constructed of any suitable materials such as wood, steel, aluminum, or plastic, lightness and durability factors being considerations in the choice of materials. Also, it will be obvious that the table may be used indoors and outdoors, and for purposes other than picnic occasions.

Although the preferred embodiment of the foldable picnic table has been described, it will be understood within the purview of this invention that various changes may be made in the forms, details, proportions, angles and arrangement of parts, the combination thereof and mode of operation, which generally stated consists in a device capable of carrying out the objects set forth as disclosed and defined in the appended claims. For example, the folding braces 28, while remaining substantially vertical, may be moved somewhat towards or away from the center of the table. Specifically, the point of attachment of brace 28 to table leg 16 may coincide with pivot point 60. Similarly, folding braces 52, while remaining substantially vertical, may be moved somewhat up or down.

What is claimed is:

1. A picnic table foldable between an open operative position and a closed position, comprising:

two U-shaped table legs each having two upper elements connected at the lower end thereof to a lower connecting element, the free ends of each said upper element of one leg being pivotably connected to the respective free ends of the other leg;

a center beam connecting the opposite connected ends of said table legs;

two folding leg braces each connecting opposite upper elements of said pair of table legs, each said leg brace being pivotable at a center pivot thereof and pivotably connected at the ends thereof to the respective upper elements of said table legs, said leg braces having locking means at their center pivots for locking said leg braces into a substantially horizontal position when the table is in an open position, said leg braces thereby forming closed triangles with the upper ends of the respective ones of said upper elements when in the open position;

two table leaves connectable at connecting edges thereof to form a horizontal table surface when the table is in the open position;

connecting means connected to said table leaves at the connecting edges thereof for connecting said table leaves when the table is in the open position;

four table supports, each of said table supports being pivotably connected at one end thereof to the underside of one of said table leaves at a corner opposite said connecting edge and pivotably connected at the other end thereof to the upper portion of one of said upper elements of said table legs;

four folding table braces each being pivotable at a center pivot thereof and pivotably connected at one end thereof to a respective one of said table supports and pivotably connected at the other end thereof to a respective one of said upper elements below the connection of the respective one of said table supports thereto, said table braces having locking means at their center pivots for locking said table braces into a substantially vertical position when the table is in an open position, said table braces thereby forming a closed triangle with the respective table supports and upper leg elements when in the open position;

two seat portions;

four seat supports each fixedly connected at one end thereof to the underside of one of said seat portions near a respective end thereof and each said seat support being pivotably connected at the opposite end thereof to a respective upper element of said table legs;

two U-shaped seat legs each having two upper members connected at the lower end thereof to a bottom member, each free end of each said upper member being pivotably connected to the underside of the opposite ends of a respective one of said seat portions; and clip means for releasably connecting each said bottom member of said seat legs to the respective one of said lower connecting element of said table legs.

2. A picnic table in accordance with claim 1 wherein said locking means of each of said leg and table braces comprises stop means in the vicinity of each said center pivot for permitting said braces to unfold from the closed positions thereof to a position slightly past rectilinear and then stopping said braces, whereby pressure exerted on said braces toward the center thereof will force said stop means into tighter engagement.

3. A picnic table in accordance with claim 2 wherein each of said leg and table braces comprises two brace halves connected together by means of a pivot pin and wherein each said stop means comprises:

a tab formed in each of said brace halves at the ends thereof connected together by said pivot pin, each said tab being bent toward the other when in the operative position, whereby said brace halves may be rotated about said pivot pin until said two tabs come into contact thereby preventing further rotation, wherein the end of each tab is dimensioned such that said contact does not occur until said brace halves have rotated slightly past rectilinear; and a U-shaped cover covering three sides of said brace at the intersection of said brace halves, said pivot pin passing through said cover thereby holding said cover in place.

4. A picnic table in accordance with claim 1 wherein said connecting means comprises a plurality of dowels on one of said connecting edges and a plurality of mating dowel holes on the opposite connecting edge and a plurality of hook elements connected to one of said table leaves at the connecting edge thereof and a plurality of mating slot elements connected to the other one of said table leaves at the connecting edge thereof, said slot elements having self-locating means associated therewith for guiding said hook elements into the respective slot elements when the connecting edges of said table leaves are being brought together when placing the table into the open position.

5. A picnic table in accordance with claim 1 further including at least one tie bar pivotably connected to the underside of one of said table leaves and retaining means connected to the underside of each of said table leaves for retaining said tie bar in a position spanning said connecting edge when said table is in an open position and said tie bar is rotated into a position spanning said connecting edge.

6. A picnic table in accordance with claim 1 wherein said table legs, said center beam, said table supports, said seat supports and said seat legs are formed of lightweight tubular metal, and wherein all free ends of said tubes are rolled inwardly.

7. A picnic table in accordance with claim 6 wherein said table leaves and said seat portions are wooden.

8. A picnic table in accordance with claim 7 wherein said lightweight metal is aluminum.

9. A picnic table in accordance with claim 1 wherein said table legs extend beyond the vertical projection of said seat portion in the open position thereby causing the table to be tilt-proof.

10. A picnic table in accordance with claim 7 further including hinge means pivotably connecting said table supports to said table leaves and said seat legs to said seat portions, each of said hinge means having an element connected to said wooden table leaf or seat portion, said element having at least two opposite edges thereof sharpened and bent 90° so as to be pressed into the wood to improve the connection, said elements also being retained by wood screws.

* * * * *